US011467542B2

(12) United States Patent
Mercier et al.

(10) Patent No.: US 11,467,542 B2
(45) Date of Patent: Oct. 11, 2022

(54) METHOD FOR MANUFACTURING A MECHANISM

(71) Applicant: LVMH SWISS MANUFACTURES SA, La Chaux-de-Fonds (CH)

(72) Inventors: Thomas Mercier, La Chaux-de-Fonds (CH); Christian Guichard, Passonfontaine (FR); Guy Semon, Evette-Salbert (FR)

(73) Assignee: LVMH SWISS MANUFACTURES SA, La Chaux-de-Fonds (CH)

( * ) Notice: Subject to any disclaimer, the term of this patent is extended or adjusted under 35 U.S.C. 154(b) by 0 days.

(21) Appl. No.: 16/608,319

(22) PCT Filed: Apr. 24, 2018

(86) PCT No.: PCT/EP2018/060505
§ 371 (c)(1),
(2) Date: Oct. 25, 2019

(87) PCT Pub. No.: WO2018/197516
PCT Pub. Date: Nov. 1, 2018

(65) Prior Publication Data

US 2020/0192299 A1 Jun. 18, 2020

(30) Foreign Application Priority Data

Apr. 25, 2017 (FR) ..... 17 53603

(51) Int. Cl.
*G04D 3/00* (2006.01)
*G04B 17/04* (2006.01)

(52) U.S. Cl.
CPC ..... *G04D 3/0035* (2013.01); *G04B 17/045* (2013.01); *Y10T 29/49579* (2015.01)

(58) Field of Classification Search
CPC ..... G04D 3/0035; G04B 17/045; Y10T 29/49579
See application file for complete search history.

(56) References Cited

U.S. PATENT DOCUMENTS 3,763,544 A * 10/1973 Gibson, Jr. ..... B41J 1/20 148/528
7,438,465 B2 * 10/2008 Bitterli ..... G04D 3/0046 368/322

(Continued)

FOREIGN PATENT DOCUMENTS

EP 2105806 A1 * 9/2009 ..... G04B 17/045
WO WO2012109559 A1 8/2012
WO WO2016091823 A1 6/2016

OTHER PUBLICATIONS

International Search Report related to Application No. PCT/EP2018/060505 dated Jun. 8, 2018.

*Primary Examiner* — Sarang Afzali
(74) *Attorney, Agent, or Firm* — von Briesen & Roper, s.c.

(57) ABSTRACT

A method for manufacturing at least a part of a timepiece is disclosed. The method comprises a first step of assembling flat layers together to from a substantially flat multilayer structure, Wherein at least a first layer of said layers is designed to form one flexible blade in the timepiece. Then, the multilayer structure is deployed in a direction substantially normal to the flat layers. Then at least one mass is fixed to the flexible blade, the mass being more rigid than the flexible blade.

18 Claims, 14 Drawing Sheets

(56) References Cited

U.S. PATENT DOCUMENTS

| | | | | |
|---|---|---|---|---|
| 7,572,050 | B2 * | 8/2009 | Bitterli | G04D 3/0046 368/324 |
| 7,575,369 | B2 * | 8/2009 | Bitterli | G04B 13/026 368/324 |
| 9,075,394 | B2 * | 7/2015 | Stranczl | G04B 15/06 |
| 10,372,082 | B2 * | 8/2019 | Semon | G04B 29/04 |
| 10,528,005 | B2 * | 1/2020 | Semon | G04B 15/06 |
| 2013/0163391 | A1 * | 6/2013 | Helfer | B22D 25/026 368/101 |
| 2016/0184041 | A1 | 6/2016 | Gafford et al. | |

* cited by examiner

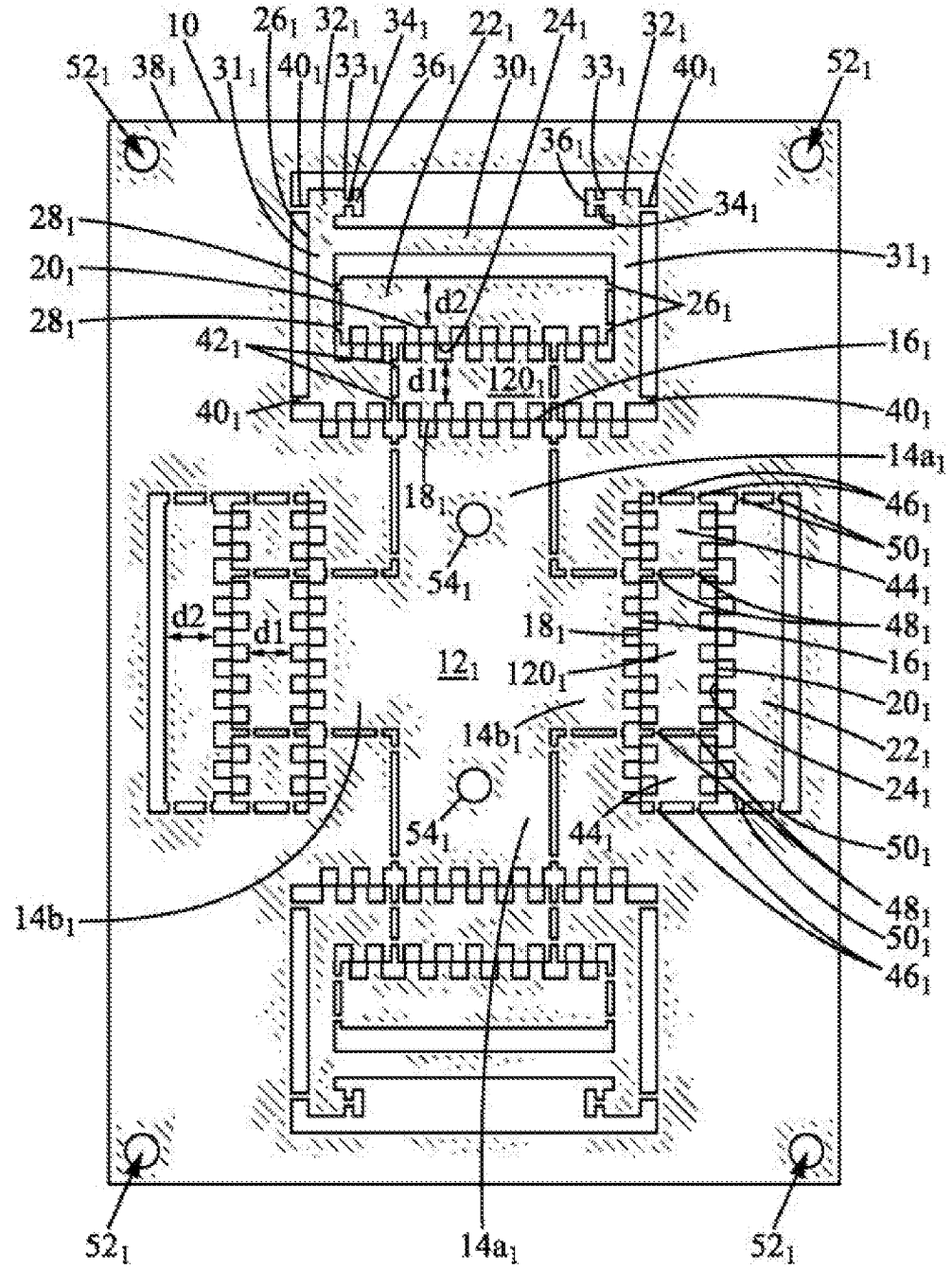
FIG. 1
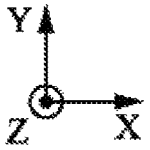

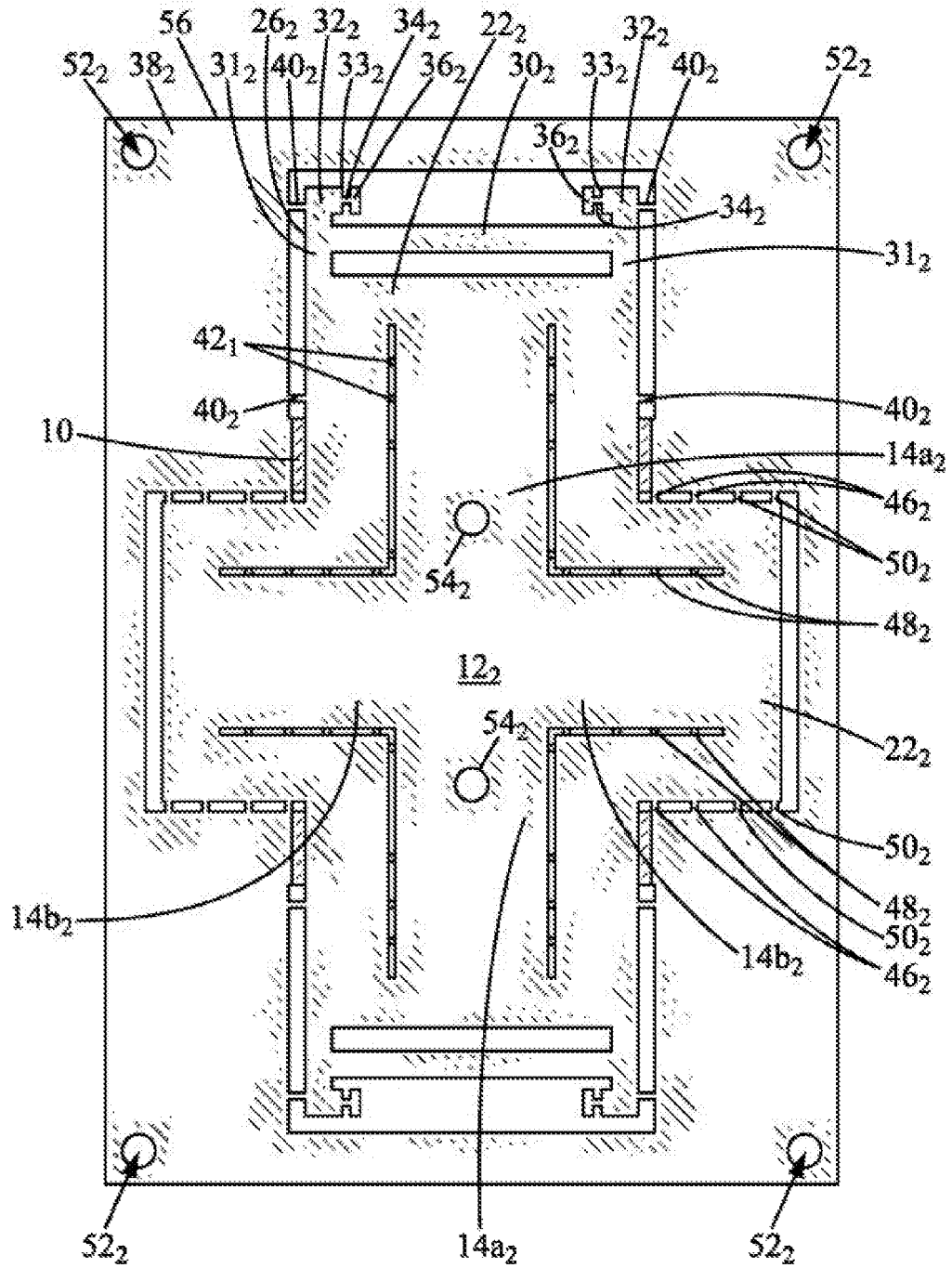
FIG. 2
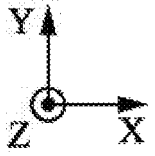

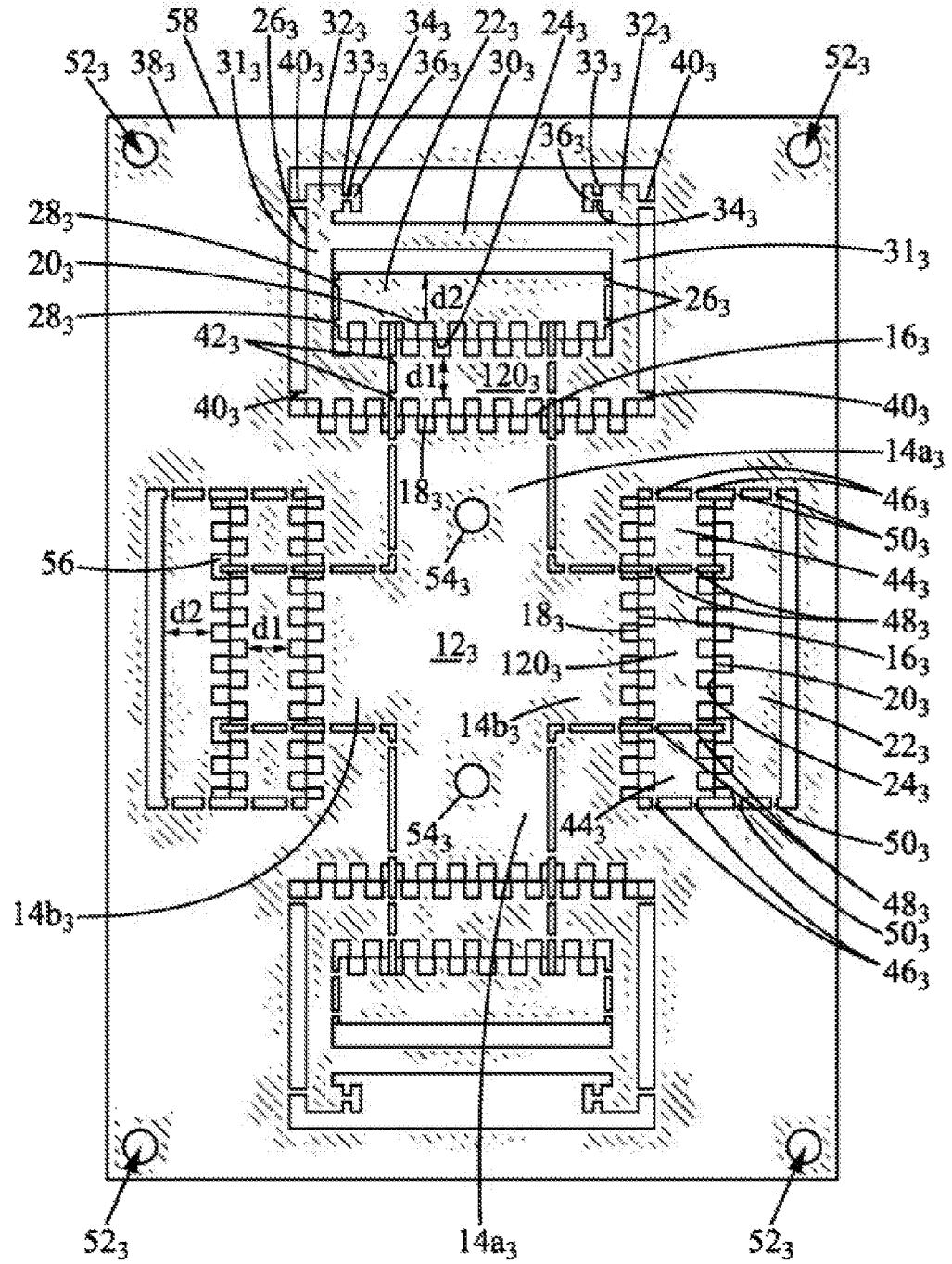
FIG. 3
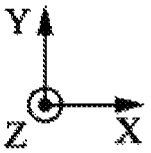

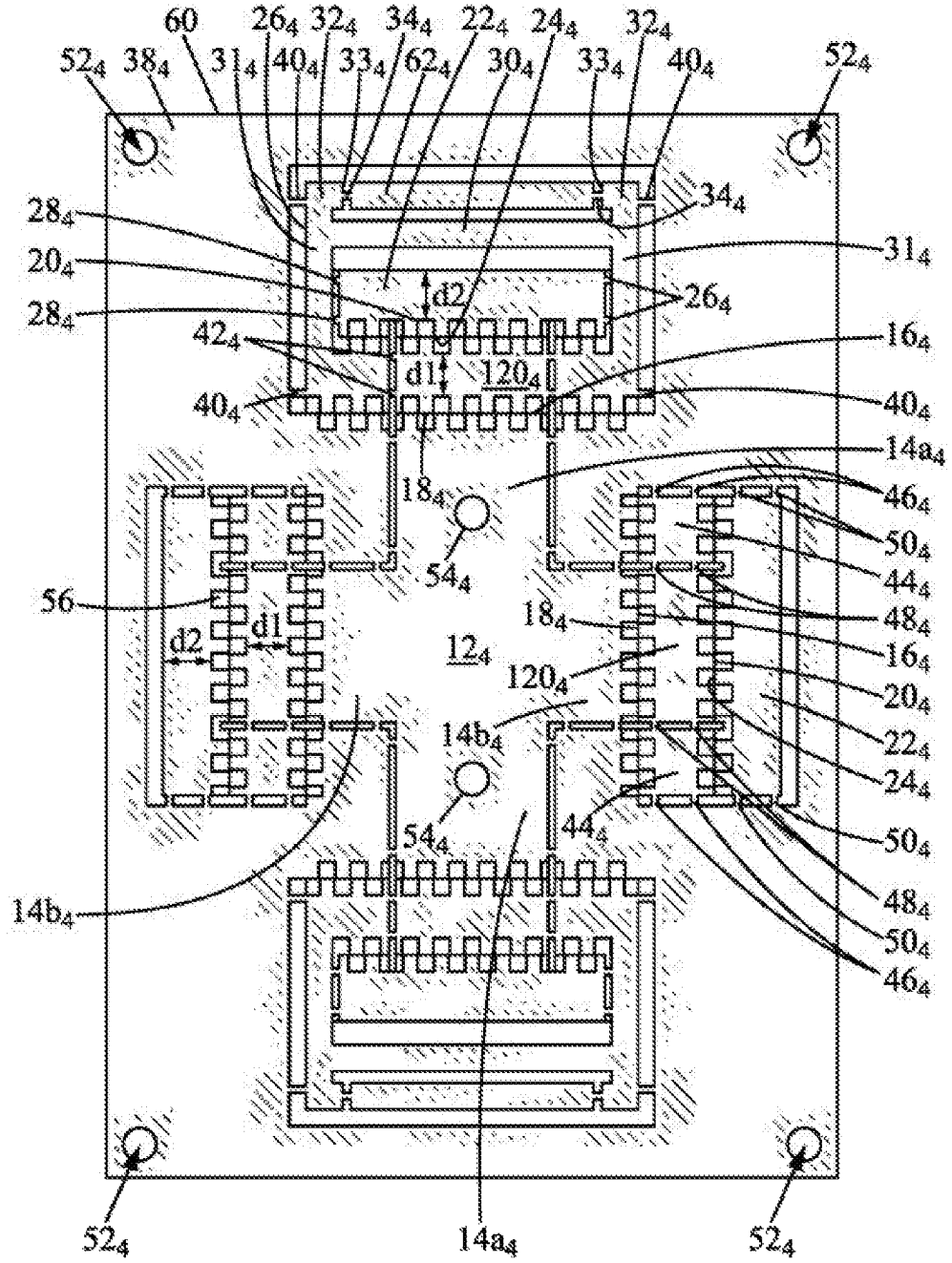
FIG. 4
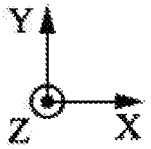

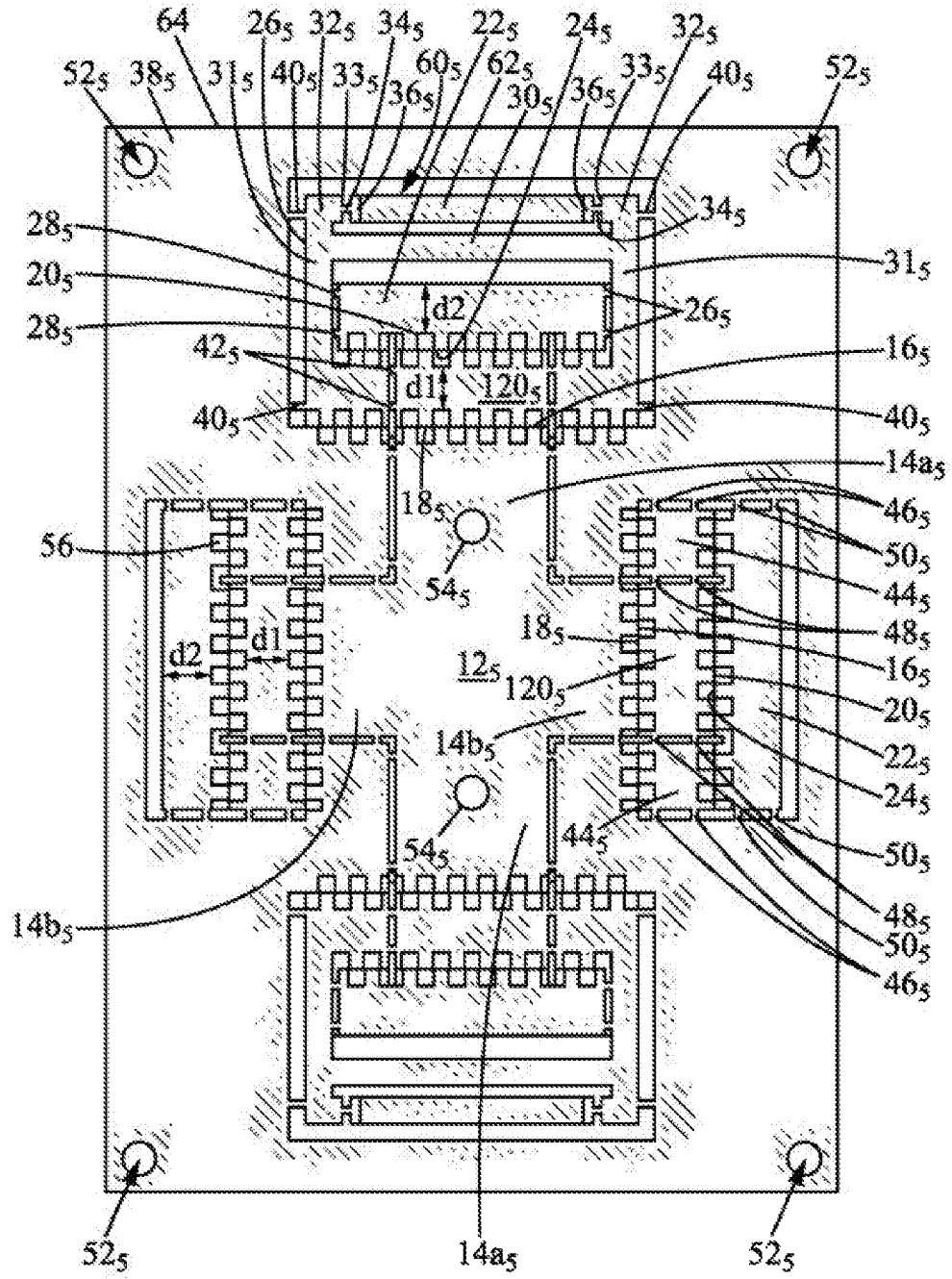
FIG. 5
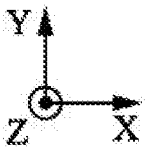

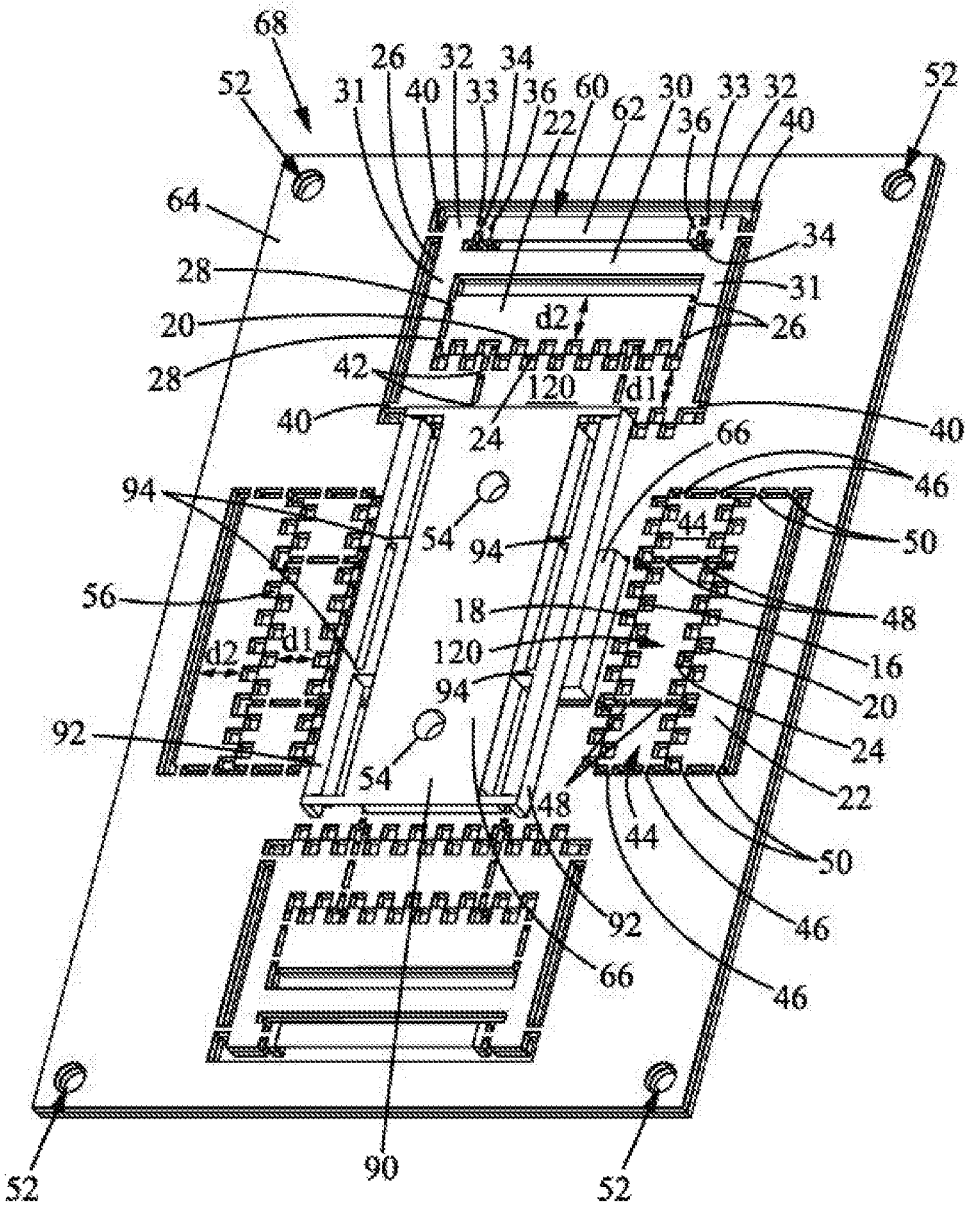
FIG. 6
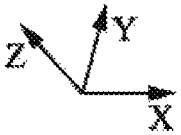

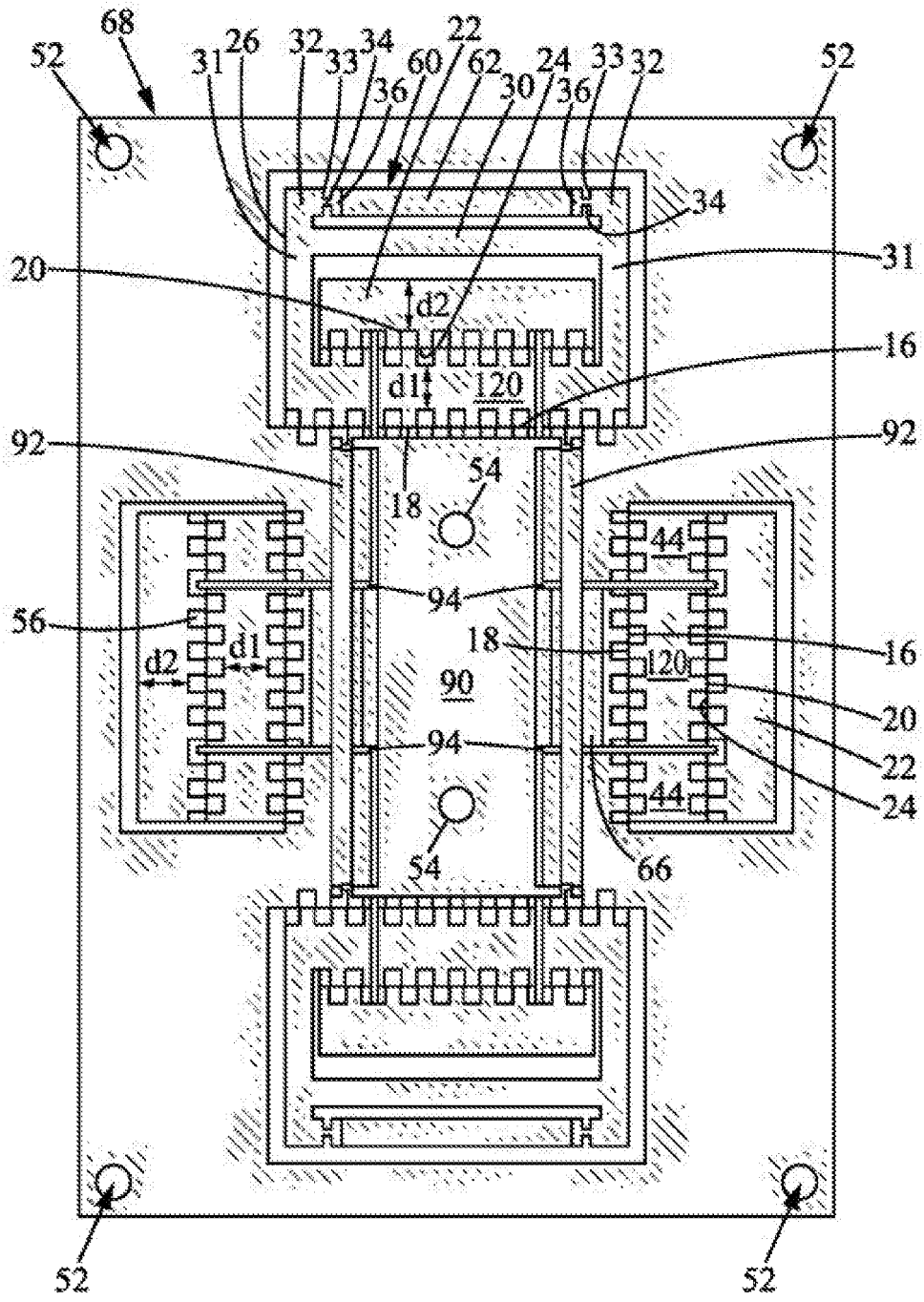
FIG. 7
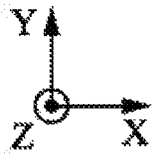

METHOD FOR MANUFACTURING A MECHANISM

CROSS-REFERENCE TO RELATED APPLICATION

This Application is a 35 USC § 371 US National Stage filing of International Application No. PCT/EP2018/060505 filed on Apr. 24, 2018 and claims priority under the Paris Convention to French Patent Application No, 17 53603 filed on Apr. 25, 2017.

FIELD OF THE DISCLOSURE

The present invention relates to a method for manufacturing a mechanism, in particular a flexible mechanism, and the use of this method for manufacturing all or part of a timepiece movement, in particular a regulating member for a timepiece movement. The invention also relates to a mechanism, in particular a timepiece movement, made wholly or in part by using this method.

BACKGROUND OF THE DISCLOSURE

In the field of timepiece making, it is known to create all or part of a timepiece movement in a monolithic manner. In particular, the regulating member of a timepiece movement can be made monolithically.

Application WO-A-2016/091823 in the name of the Applicant describes such a timepiece movement regulating member obtained from a silicon wafer, in particular by etching the silicon wafer. Such a monolithic regulating member thus has a limited number of parts that move relative to one another. This limits the number of areas of friction, located at the parts in contact, which are moving relative to one another.

However, the creation of a timepiece movement regulating member from a single wafer of material poses certain difficulties.

First, it is generally necessary to include a shaping step, for example an etching step, which must be implemented in a clean room. This induces an additional cost to creating the timepiece movement.

Then, the geometry of the constituent elements of the timepiece movement is restricted. For example, with current techniques it is difficult to create a blade flexible in any orientation, having an aspect ratio greater than about 25, at this scale. One will recall that the aspect ratio of a flexible blade is defined by the ratio of its width to its thickness. One will also recall that the length of a blade is the dimension in the direction passing through the anchoring points of the blade. The length thus generally corresponds to the largest dimension of the blade. The thickness of the blade is its smallest dimension. Finally, the width is the "intermediate" dimension of the blade, larger than its thickness but smaller than its length. It should be noted, however, that in certain specific cases the width of a blade may be substantially equal to its length.

However, such a flexible blade, or "flexure", is used in a timepiece movement in order to create a regulating member. A regulating member is an oscillating device. A flexible blade with the largest possible aspect ratio is preferred in this case, particularly when the width of the blade extends in a plane substantially perpendicular to the base plane of the oscillator. In this case, indeed a large aspect ratio makes it possible to limit the oscillations of the blade outside the base plane of the oscillator.

In addition, at constant width, increasing the aspect ratio reduces the thickness of the flexible blade. A flexible blade of reduced thickness is also preferred because it allows oscillation of the regulating member at a lower natural frequency.

Moreover, in such a monolithic regulating member, the same material serves both for the flexible blades and for the rigid masses which are connected by the flexible blades. This therefore limits the design possibilities of the regulating member, particularly concerning the material used.

However, there is a known method, for example from application WO-A-2012/109559, for manufacturing a three-dimensional structure comprising the following steps.

First, different layers of different materials, previously machined, are superimposed and assembled to obtain a flat multilayer structure. The layers comprise fold starters in the layer concerned and/or breakage starters. It is then possible to build the flat multilayer structure by pulling on one of the layers in a direction substantially normal to the plane of the flat multilayer structure. A three-dimensional deployed structure is thus obtained.

In this type of method, it is known to use rigid layers to create rigid parts of the three-dimensional structure, and flexible layers to form hinges between the rigid parts. The hinges thus formed can, if necessary, be locked after deployment of the three-dimensional structure, in particular by gluing or laser welding.

In the case of application WO-A-2012/109559, the parts attached to a flexible layer are so attached during the step of superimposing and assembling the flat layers. This allows the easy creation of a hinge between the parts attached to the flexible layer. Moreover, in the final three-dimensional structure, the flexible layer extends over a very small distance between the rigid parts that it connects, the flexible layer primarily forming an angle between the rigid parts.

Thus, the method described in application WO-A-2012/109559 is limited in the variety of structures it can create.

SUMMARY OF THE DISCLOSURE

One object of the invention is to provide a method for manufacturing a wide variety of mechanisms.

To this end, the invention provides a method for manufacturing a mechanism, in particular a flexible mechanism, comprising the steps of:

i) assembling flat layers together to form a substantially flat multilayer structure;

ii) deploying the multilayer structure in a direction substantially normal to the flat layers;

a method wherein at least a first layer of said layers forms at least one flexible blade in the mechanism, the blade or blades being fixed, in the mechanism, to at least one mass, preferably to two masses, the or each mass being more rigid than the blade or blades, the blade or blades being fixed to the or to each mass in a step subsequent to step ii).

Thus, advantageously, the method according to the invention makes it possible to produce a mechanism having at least one flexible blade fixed to one or more rigid masses. Such a method is advantageously applicable in many fields, in particular in the mechanisms within spectacles or timepieces. In the latter case in particular, the method according to the invention makes it possible, for example, to produce an oscillating regulating member with one or more flexible blades of substantially constant and reduced dimensions, for example of a thickness between 2 and 25 μm, giving access to lower oscillation frequencies of the regulating member than those generally obtained in the case of a monolithic regulating member created by known methods. The method according to the invention also makes it possible to obtain one or more flexible blades having a high aspect ratio, in particular higher than that traditionally obtained in the case of a monolithic regulating member created by methods conventionally applied at this scale, meaning at the centimeter scale.

According to preferred embodiments, the method according to the invention comprises one or more of the following features, alone or in combination:

- each blade has, in the mechanism, a free length greater than one third of the width of the blade in question, the free length being defined as being:
  - the length of the blade which is not in contact with the mass, in the case where the blade is fixed to a mass, or
  - the length of the blade extending between the two masses without being in contact with one of the masses, in the case where the blade is fixed to two masses,
- the or each blade preferably not being in contact with any other element of the mechanism along its free length;
- the method comprises a step iii) subsequent to step ii), consisting of locking the multilayer structure in the deployed position;
- in step iii), the structure is locked in the deployed position by at least one among: an overmolding, brazing, clipping, gluing, welding, particularly spot welding, more particularly laser spot welding, and clamping, of at least a portion of the mechanism, in particular of at least one hinge of the mechanism;
- the or each mass is attached to an end, preferably to a respective end, of one of said at least one blade;
- the or each mass is fixed to the blade or to each blade by: overmolding; brazing: clipping: gluing; welding, particularly spot welding, more particularly laser spot welding; clamping;
- the mass or masses are created by at least one of the flat layers assembled in step i);
- the mass or masses are of one among: tungsten, molybdenum, gold, silver, tantalum, platinum, alloys comprising these elements and a polymer material loaded with particles of a density greater than ten, in particular tungsten particles;
- the blade or blades are of one among: silicon, glass, sapphire, diamond, in particular synthetic diamond, in particular synthetic diamond obtained by a chemical vapor deposition process, titanium, a titanium alloy, particularly an alloy of the Gum Metal® family and an alloy of the elinvar family, more particularly Elinvar®, Nivarox®, Thermelast®, Ni-Span-C®, Precision C®;
- in step i), ten to fifty flat layers are assembled together;
- the blade or blades have a width, a thickness, and an aspect ratio defined as being equal to the ratio of the width of the blade to the thickness of the blade, the aspect ratio of each blade being greater than 10, preferably greater than 25;
- the blade or blades have a thickness greater than or equal to 1 μm, preferably greater than or equal to 5 μm, and/or less than or equal to 30 μm, preferably less than or equal to 20 μm, more preferably less than or equal to 15 μm;
- the blade or blades have a width greater than or equal to 0.1 mm and/or less than or equal to 2 mm, preferably less than or equal to 1 mm;
- the substantially flat multilayer structure forms at least one mounting scaffold, the method comprising a step iv), preferably subsequent to step iii) where appropriate, consisting of detaching the structure, in the deployed position, from the at least one mounting scaffold;
- each layer undergoes a machining step, preferably before its assembling, in particular laser cutting, industrial etching, stamping, milling, electrical discharge machining, and/or a shaping step, particularly a shaping step by adding material, more particularly a shaping step by LIGA or by injection molding;
- a plurality of substantially flat multilayer structures, respectively structures in the deployed position, are obtained in step ii), respectively in step iii), from a single assembling of layers in step i); and
- the or each blade is of a more flexible material than the or each mass which is fixed to said blade.

According to another aspect, the invention relates to a use of the method as described above, in all its combinations, for manufacturing all or part of a timepiece movement, in particular a regulating member for a timepiece movement.

According to yet another aspect, the invention relates to a mechanism, in particular a timepiece movement for a timepiece, made wholly or in part by implementing a method as described above in all its combinations.

More generally, described in the present application is a method for manufacturing a mechanism, particularly a flexible mechanism, comprising the steps of:

i) assembling flat layers together to form a substantially flat multilayer structure;

ii) deploying the multilayer structure in a direction substantially normal to the flat layers;

a method wherein at least a first layer of said layers forms at least one flexible blade in the mechanism. The blade or blades are fixed, in the mechanism, to at least one mass, preferably to two masses, the or each mass being more rigid than the blade or blades. The blade or blades may initially extend substantially in the initial plane of said first layer, so that the length and width of the blade or blades extend in the plane of the flat multilayer structure while the thickness of the blade or blades corresponds to the thickness of the first layer and extends substantially perpendicular to the plane of the flat multilayer structure. In the deployed structure, however, the blade or blades extend out of the plane of the flat multilayer structure. In particular, in the deployed structure, the blade or blades may extend substantially perpendicular to the plane of the flat multilayer structure, so that the thickness and length of the blade or blades extend in a plane parallel to the plane of the flat multilayer structure, and the width of the blade or blades extends out of the plane, in particular substantially perpendicular to the plane of the flat multilayer structure.

In this most general case, the blade or blades can be fixed to the mass or masses during the layer assembling step, when the mass or masses are formed by one or more layers of the multilayer structure.

Also described is a mechanism, in particular a flexible mechanism, obtained by implementing this method. The mechanism may in particular form all or part of a timepiece movement, more particularly all or part of a regulating member of a timepiece movement.

The additional features listed above may also be implemented in this method or in this mechanism.

BRIEF DESCRIPTION OF THE DRAWINGS

The invention will be better understood from the description which follows, given with reference to the accompanying drawings. In these drawings:

FIGS. 1 to 12 schematically illustrate the different steps of an exemplary method for manufacturing a mechanism, FIG. 9 illustrating particular details of FIG. 8;

DETAILED DESCRIPTION

Figure 8:
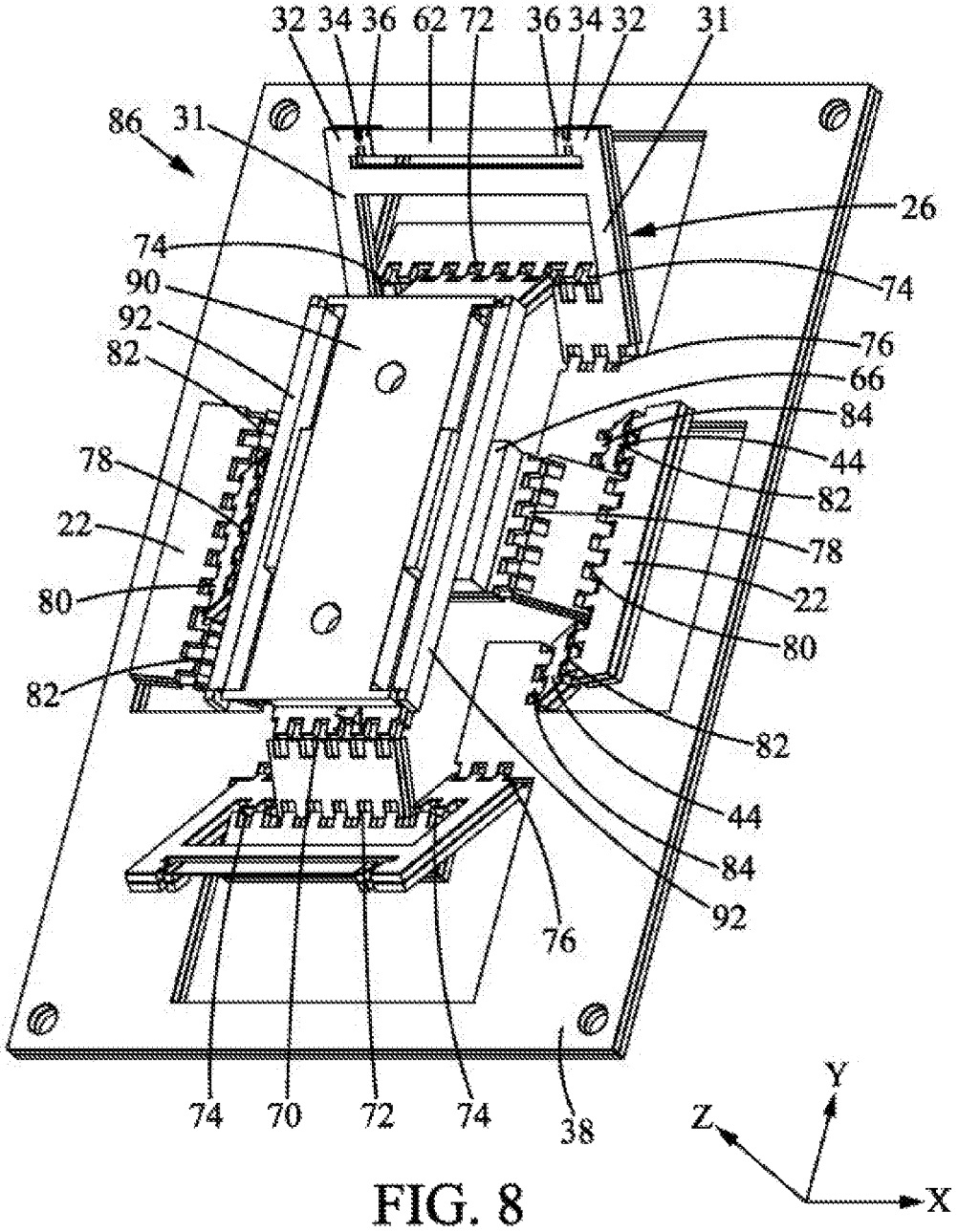

In the remainder of the description, elements of the various layers described that are identical or of identical function bear the same reference followed by an index indicating the number of the layer of which this element is a part. The assembly formed by the superposition of identical elements of different layers again bears the same reference, but with no index. In order to provide a more concise description, the elements that are identical or of identical function are not described for each figure.

Firstly, with reference to FIGS. 1 to 12, an example of a method for manufacturing a flexible mechanism is described, in particular a mechanism with flexible blade(s). In a known manner, a flexible mechanism or connection with an elastic hinge is a construction component fulfilling a kinematic function by using the physical principle of elasticity of a material. In a mechanism with flexible blade(s), the elasticity of one or more blades is used.

FIG. 1 shows a first layer 10 of a first material. Here, the first layer 10 is in the form of a substantially rectangular plate. For easier understanding of the description which follows, a trihedron X, Y, Z is defined in which:

- direction X corresponds to the transverse direction of the layer 10;
- direction Y corresponds to the longitudinal direction of the layer 10; and
- direction Z corresponds to the direction normal to the layer 10, such that the trihedron X, Y, Z is a direct trihedron.

Various cuts are made in the first layer 10, in particular in order to create fold starters and/or breakage starters in the first layer 10. These cuts firstly form a cross $\mathbf{12}_1$ in the central part of the first layer 10. The cross $\mathbf{12}_1$ has four arms $\mathbf{14}a_1$, $\mathbf{14}b_1$ perpendicular to one another. Two arms $\mathbf{14}a_1$, called longitudinal arms, extending substantially in direction Y, are longer than the other two arms $\mathbf{14}b_1$, called transverse arms, which extend substantially in direction X.

The two longitudinal arms $\mathbf{14}a_1$ are described first. Along each of these longitudinal arms $\mathbf{14}a_1$, cutouts form, from the center of the first layer 10 to the periphery of the first layer 10:

- a first serrated edge $\mathbf{16}_1$ extending in direction X,
- a second serrated edge $\mathbf{18}_1$ extending in direction X, the serration of the second edge $\mathbf{18}_1$ being complementary to the serration of the first edge $\mathbf{16}_1$, and
- a third serrated edge $\mathbf{20}_1$ at the end of the longitudinal arm $\mathbf{14}a_1$ in question, the third edge $\mathbf{20}_1$ extending in direction X.

"Complementary serration" is understood to mean serration that can be received one within the other, each teeth of one serration being for example received between two adjacent teeth of the other serration.

Facing the third edge $\mathbf{20}_1$ of each longitudinal arm $\mathbf{14}a_1$, the first layer 10 forms a strip $\mathbf{22}_1$ of material extending substantially in direction X. The strip $\mathbf{22}_1$ of material extends to each side of the longitudinal arm $\mathbf{14}a_1$ of the cross $\mathbf{12}_1$, the length of the strip $\mathbf{22}_1$ of material being greater than the width of the longitudinal arm $\mathbf{14}a_1$ of the cross $\mathbf{12}_1$. The strip $\mathbf{22}_1$ of material has a fourth serrated edge $\mathbf{24}_1$, facing the third edge $\mathbf{20}_1$, the serration of the third and fourth edges $\mathbf{20}_1$, $\mathbf{24}_1$ being complementary. The fourth edge $\mathbf{24}_1$ extends along substantially the entire length of the strip $\mathbf{22}_1$ of material. The peripheral edge of the strip $\mathbf{22}_1$, opposite the fourth edge $\mathbf{24}_1$, is here rectilinear, extending in the direction X.

The third serrated edge $\mathbf{20}_1$ extends to each side of the end of the longitudinal arm $\mathbf{14}a_1$, facing the fourth edge $\mathbf{24}_1$. This third edge 20, then partially defines the outline of a stirrup $\mathbf{26}_1$, to which the strip $\mathbf{22}_1$ of material is connected by tabs $\mathbf{28}_1$. The outline of the stirrup $\mathbf{26}_1$ is also partially defined by the extension of the second serrated edge $\mathbf{16}_1$, in direction X, to each side of the longitudinal arm $\mathbf{14}a_1$ of the cross 12. The stirrup $\mathbf{26}_1$ also forms a cross-member $\mathbf{30}_1$ extending substantially in direction X, two uprights $\mathbf{31}_1$ extending substantially in direction Y, and two elbows $\mathbf{32}_1$ at the end of the uprights $\mathbf{31}_1$. The elbows $\mathbf{32}_1$ are oriented towards one another. The cross-member $\mathbf{30}_1$ is arranged between the two elbows $\mathbf{32}_1$ and the strip of material $\mathbf{22}_1$, in direction Y. The elbows $\mathbf{32}_1$ here form a right angle. The free end $\mathbf{33}_1$ of the elbows $\mathbf{32}_1$ is connected, via a tab $\mathbf{34}_1$, to a pallet $\mathbf{36}_1$. The pallet $\mathbf{36}_1$ here is of substantially rectangular shape.

The stirrup $\mathbf{26}_1$ is connected by its uprights $\mathbf{31}_1$ to the peripheral edge $\mathbf{38}_1$, of the first layer $\mathbf{10}_1$, by means of tabs $\mathbf{40}_1$.

Furthermore, the first serrated edge $\mathbf{16}_1$ is extended along direction X, to each side of the longitudinal arm $\mathbf{14}a_1$ of the cross $\mathbf{12}_1$ on which it is created, facing the extension of the second longitudinal edge $\mathbf{16}_1$ partially defining the stirrup $\mathbf{26}_1$.

Finally, the stirrup $\mathbf{26}_1$ is connected by tabs $\mathbf{42}_1$ to the end portion $\mathbf{120}_1$ of the longitudinal arm $\mathbf{14}a_1$ of the cross $\mathbf{12}_1$. The end portion $\mathbf{120}_1$ of the longitudinal arm $\mathbf{14}a_1$ extends between the second edge $\mathbf{18}_1$ and the third edge $\mathbf{20}_1$.

Furthermore, each transverse arm $\mathbf{14}b_1$ has a substantially equivalent configuration. Identical elements of the longitudinal $\mathbf{14}a_1$ and transverse $\mathbf{14}b_1$ arms bear the same reference.

Thus, along each of the transverse arms $\mathbf{14}b_1$, cutouts form, from the center of the first layer 10 to the periphery of the first layer 10:

- a first serrated edge $\mathbf{16}_1$ extending in direction Y
- a second serrated edge $\mathbf{18}_1$ extending in direction Y, the serration of the second edge $\mathbf{20}_1$ being complementary to the serration of the first edge $\mathbf{18}_1$, and
- a third serrated edge $\mathbf{20}_1$ forming the end of the transverse arm $\mathbf{14}b_1$ in question, the third edge $\mathbf{20}_1$ extending in direction Y.

Facing the third edge $\mathbf{20}_1$ of each transverse arm, the first layer 10 forms a strip $\mathbf{22}_1$ of material extending substantially in direction Y. The strip $\mathbf{22}_1$ of material extends to each side of the transverse arm $\mathbf{14}b_1$ of the cross $\mathbf{12}_1$, the length of the strip $\mathbf{22}_1$ of material being greater than the width of the transverse arm $\mathbf{14}b_1$ of the cross $\mathbf{12}_1$. The strip $\mathbf{22}_1$ of material has a fourth serrated edge $\mathbf{24}_1$, facing the third edge $\mathbf{20}_1$, the serration of the third and fourth edges $\mathbf{20}_1$, $\mathbf{24}_1$ being complementary. The fourth edge $\mathbf{24}_1$ extends along substantially the entire length of the strip $\mathbf{22}_1$ of material.

The third serrated edge $\mathbf{20}_1$ extends to each side of the end of the transverse arm $\mathbf{14}b_1$, facing the fourth edge $\mathbf{24}_1$. This third edge $\mathbf{20}_1$ then partially defines the outline of a square $\mathbf{44}_1$ of material. The outline of the square $\mathbf{44}_1$ is also partially defined by the extension of the second serrated edge $\mathbf{16}_1$, in direction Y, to each side of the transverse arm $\mathbf{14}b_1$ of the cross $\mathbf{12}_1$.

The square $44_1$ is connected to the peripheral edge $38_1$ of the layer 10 by tabs 461. Furthermore, the first serrated edge $16_1$ extends in direction Y, to each side of the transverse arm $14b_1$ of the cross $12_1$ on which it is created, facing the extension of the second edge $16_1$ partially defining the square $44_1$.

The square $44_1$ is also connected to the end portion $120_1$, of the transverse arm $14b_1$ of the cross $12_1$ by tabs $48_1$. The end portion $120_1$ of the transverse arm $14b_1$ extends between the second edge $18_1$ and the third edge $20_1$.

Finally, the strips $22_1$ facing the transverse arms $14b_1$ are directly connected to the peripheral edge $38_1$, of the layer 10 by tabs 501.

It should be noted that the distance d1 between the second edge $18_1$ and the third edge $20_1$ is identical on each arm $14a_1$, $14b_1$ of the cross $12_1$. Furthermore, the width of the strips $22_1$ is identical, the width being measured between the fourth edge $24_1$ and the side of the strip $22_1$ opposite this fourth edge $24_1$. Here, the distances d1 and d2 are substantially equal.

The first layer 10 is also provided with four holes $52_1$ distributed at the corners of the first layer 10, allowing the passage of a pin to align the first layer with other layers superimposed on this first layer. Two holes $54_1$ are also made in the center of the first layer 10. The function of these two holes $54_1$ will be described below.

The first layer 10 as described above is for example created from a monolithic layer by cutting and/or shaping. The cuts can be made by any method suitable for the material of the first layer. The cuts can in particular be made by laser cutting, chemical cutting, stamping. The shaping may consist of adding material, in particular by a LIGA process (from the German "Röntgenlithographie, Galvanoformung, Abformung" which means X-ray lithography, electroplating, and molding). The cutting and/or shaping steps are preferably carried out before assembling the first layer 10 with other layers, in order to facilitate the implementation. The same is true for the other layers described below.

In FIG. 2, the first layer 10 is covered by a second layer 56 of flexible material. The flexible material may be a polymeric film, for example of polyimide. Here, for example, the flexible material is Kapton®. In practice, a layer of glue or a layer of adhesive material, substantially identical in shape to the first layer 10 or to the second layer 56, is interposed between the first layer 10 and the second layer 56.

It should be noted that cuts are made in the second layer 56 so that the second layer 56 has a shape substantially identical to the first layer 10. The second layer 56 forms for example a cross $12_2$ of identical shape to the cross $12_1$ of the first layer 10. However, the cross $12_2$ on the second layer 56 is solid, with the exception here of two holes $54_2$. In particular, the cross $12_2$ on the second layer 56 is without serrated edges. More generally, the second layer 56 as a whole is without serrated edges.

Furthermore, the arms $14a_2$, $14b_2$ of cross $12_2$ are not connected to the peripheral edge $38_2$ of the second layer 56 by tabs extending in direction X. Conversely, the arms $14a_2$, $14b_2$ are connected here to the peripheral edge $38_2$ of the second layer solely by their ends. In other words, the cross $12_2$ on the second layer 56 is without tabs connecting it to the edge $38_2$ of the second layer 56.

In FIG. 3, the second layer 56 is covered by a third layer 58. In practice, here again, a layer of glue or adhesive material is interposed between the second layer 56 and the third layer 58, the layer of glue being for example of identical shape to the third layer 58.

The third layer 58 is here of identical shape to the first layer 10. Thus, in FIG. 3, the second layer 56 appears between the serration of the facing serrated edges.

In FIG. 4, the third layer 58 is covered by a fourth layer 60. Here again, in practice, a layer of glue or adhesive material is interposed between the third layer 58 and the fourth layer 60. This layer of glue or adhesive material is substantially identical in shape to the third layer 58.

The fourth layer 60 is of substantially identical shape to the third layer 58.

The fourth layer 60 differs from the first 10 and third 58 layers essentially in that the free ends $33_4$ of the elbows $32_4$ are connected, each via a respective tab $34_4$, to a same blade 62.

The fourth layer 60 is preferably made of a material different from the constituent materials of the first and third layers 10, 58, which may be of the same material if appropriate. In particular, the fourth layer 60 may be of a more flexible material than the first and third layers 10, 58. Additionally or alternatively, the fourth layer 60 may be thinner than the first and third layers 10, 58, particularly in the case where all these layers are of the same material.

In the example, the fourth layer 60 is then covered with a fifth layer 64 as illustrated in FIG. 5.

This fifth layer 64 is also fixed to the fourth layer 60, for example by gluing. To achieve this, a layer of glue or adhesive material, for example of similar shape to the fifth layer 64, is interposed between the fourth 60 and fifth 64 layers.

The fifth layer 64 is of identical shape to the first and third layers 10, 58. This fifth layer 64 is for example of a material that can be brazed or welded, unlike the fourth layer 60. This fifth layer 64 does not form a blade superimposed on the blade 62 formed by the fourth layer 60.

This gives a substantially flat multilayer structure 68, visible in particular in FIG. 6.

Finally, in the example method described with reference to the figures, a base 66 is arranged on the fifth layer 64, as shown in FIG. 6. This base 66 is positioned relative to the flat multilayer structure 68, particularly by means of holes 54 which can receive guide pins. Then the base 66 receives a support 90 with two rails 92, connected to the support 90 by means of breakable tabs 94. Here again, the correct positioning of the support 90, and therefore of the rails 92, relative to the flat multilayer structure 68 is obtained due to the holes 54 and the guide pins received therein. It should be noted here that the support 90, the rails 92, and the tabs 94 can be created as one piece. In particular, the support 90, the rails 92, and the tabs 94 can be obtained by implementing the same methods as described above for creating the various layers described above. It should also be noted that in the described example, the support 90 is placed on the base 66 without being fixed thereto.

The method for manufacturing a mechanism then continues with a step of cutting out tabs 28, 40, 42, 46, 48, 50. This step results in the substantially flat multilayer structure 68 of FIG. 7 in which:

- the stirrups 26 are detached from the edge 38 of the superimposed layers 10, 56, 58, 60, 64;
- the strips 22 are detached from the stirrups 26; and
- the squares 44 are detached from the edge 38 of the superimposed layers 10, 56, 58, 60, 64 and of the end portions 120 of the transverse arms 14*b* of the cross 12.

Figure 9:
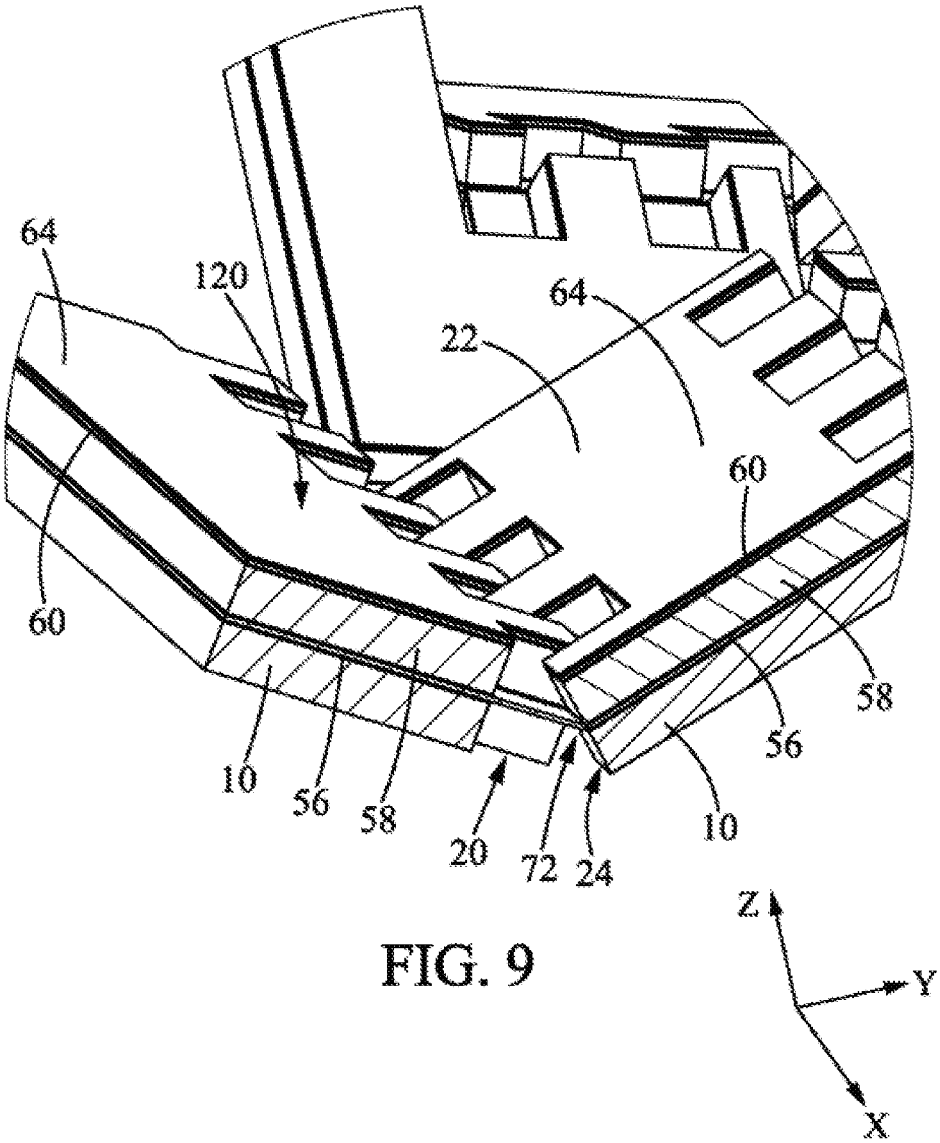
Figure 10:
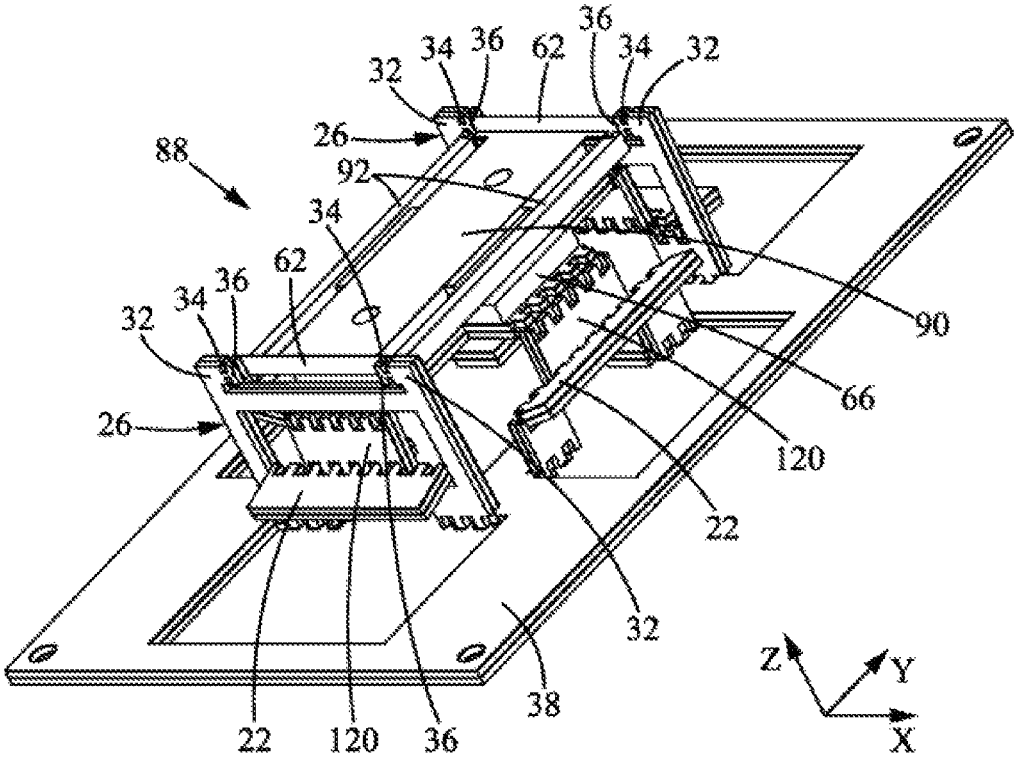

The manufacturing method then continues with a step of deployment along an axis Z substantially normal to the plane of the multilayer structure 68, this step being illustrated in FIGS. 8 to 10. In other words, the multilayer structure 68 of FIG. 7 is deployed to extend in direction Z normal to the flat plane of the flat multilayer structure 68. A three-dimensional deployed structure 88 is thus obtained.

FIG. 8 illustrates an intermediate state of the multilayer structure 68, before reaching its final deployed state illustrated in FIG. 10.

Here, because of the pulling in the Z direction, and as shown in FIG. 8, hinges—meaning connections essentially enabling a rotation—are formed at the facing serrated edges.

FIG. 9 illustrates, by way of example, the formation of a hinge 72 at the third and fourth edges 20, 24 of a longitudinal arm 14*a* of the cross 12 and the facing strip 22 of material. In this FIG. 9, the serration of the third and fourth edges 20, 24 of the third, fourth, and fifth layers 58, 60, 64 come together, the teeth of one serration being received between two adjacent teeth of the other serration. Conversely, the third and fourth edges 20, 24 of the first layer 10 move away from one another. Under these conditions, the second layer 56, without any serrated edges, remains as one piece and extends continuously between the base of the longitudinal arm 14*a* (to the right in FIG. 9) and the end portion 120 of the longitudinal arm 14*a* (to the left in FIG. 9). The second layer 56 then forms a hinge 72.

Together with the second layer 56, the serrated edges previously mentioned thus form the following hinges:

- a first hinge 70 of axis X between the base of each longitudinal arm 14*a* and the corresponding end portion;
- a second hinge 72 of axis X between the end portion 120 of each longitudinal arm 14*a* and the facing strip 22;
- two third hinges 74 of axis X between each strip 22 of material facing a longitudinal arm 14*a* and the associated stirrup 26;
- two fourth hinges 76 of axis X between each stirrup 26 and the edge 38 of the different layers;
- a fifth hinge 78 of axis Y between the base of each transverse arm 14*b* and the corresponding end portion;
- a sixth hinge 80 of axis Y between the end portion of each transverse arm 14*b* and the facing strip 22;
- two seventh hinges 82 of axis Y between each strip 22 of material facing a transverse arm 14*b* and the two associated squares 44;
- an eighth hinge 84 of axis Y between each square 44 and the edge 38 of the different layers.

Thus, by choosing perpendicular orientations of the hinges, a Sarrus linkage 86 is formed here. This Sarrus linkage is a particular example of a mounting scaffold that can be used in the method.

Such a mounting scaffold is created by the multilayer structure, in addition to the structure that we wish to create. This mounting scaffold makes it possible to connect the various movements required for the deployment of the multilayer structure, so that this deployment can be achieved by acting on the multilayer structure along a single degree of freedom. This mounting scaffold thus facilitates the deployment step.

The Sarrus linkage 86 so produced causes, by pulling on a portion of the multilayer structure 68 in direction Z, a raising of the stirrups 26. The raising of the stirrups 26 is accompanied by the blades 62 of the support 66 moving closer together. The raising of the stirrups 26 also causes the blades 62 to pivot, so that their width extends in a direction normal to the plane of the flat multilayer structure 68, the length and thickness of the blades extending substantially in a plane parallel to the plane of the flat multilayer structure 68. Thus, from a blade initially adapted to oscillate in a plane normal to the plane of the flat multilayer structure 68, a blade is obtained that is adapted to oscillate in a plane parallel to the plane of the multilayer structure 68.

A deployed multilayer structure 88 is thus obtained, as shown in FIG. 10. It should be noted here that the structure is not initially locked in this deployed position. A step of locking the multilayer structure in its deployed configuration 88 can be implemented. This step can be carried out in many ways. For example, here, we can lock some or all of the abovementioned hinges by brazing or gluing.

In addition, in this step or after the locking step, the pallets 36 fixed to the ends of the blades 62 can be fixed to masses 92, here in the form of rails. This can be achieved by brazing. In this case, a metal plate can be glued to each end of the masses 92, thus allowing a brazing attachment.

Figure 11:
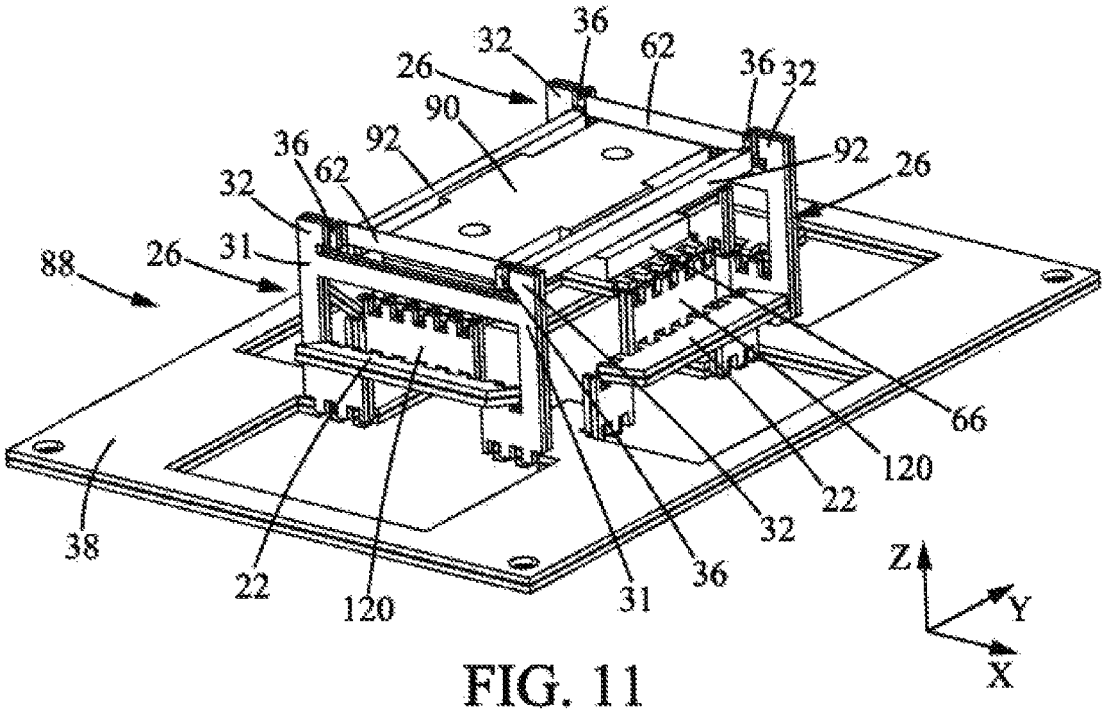

FIG. 11 illustrates the detachment of the assembly formed by the masses 92 secured to the blades 62 via the pallets 36, from the rest of the deployed multilayer structure 88. This is done by cutting the tabs 34 connecting the pallets 36 and the blade 62 to the stirrups 26, as well as the tabs 94 connecting the masses 92 to the support 90.

Figure 12:
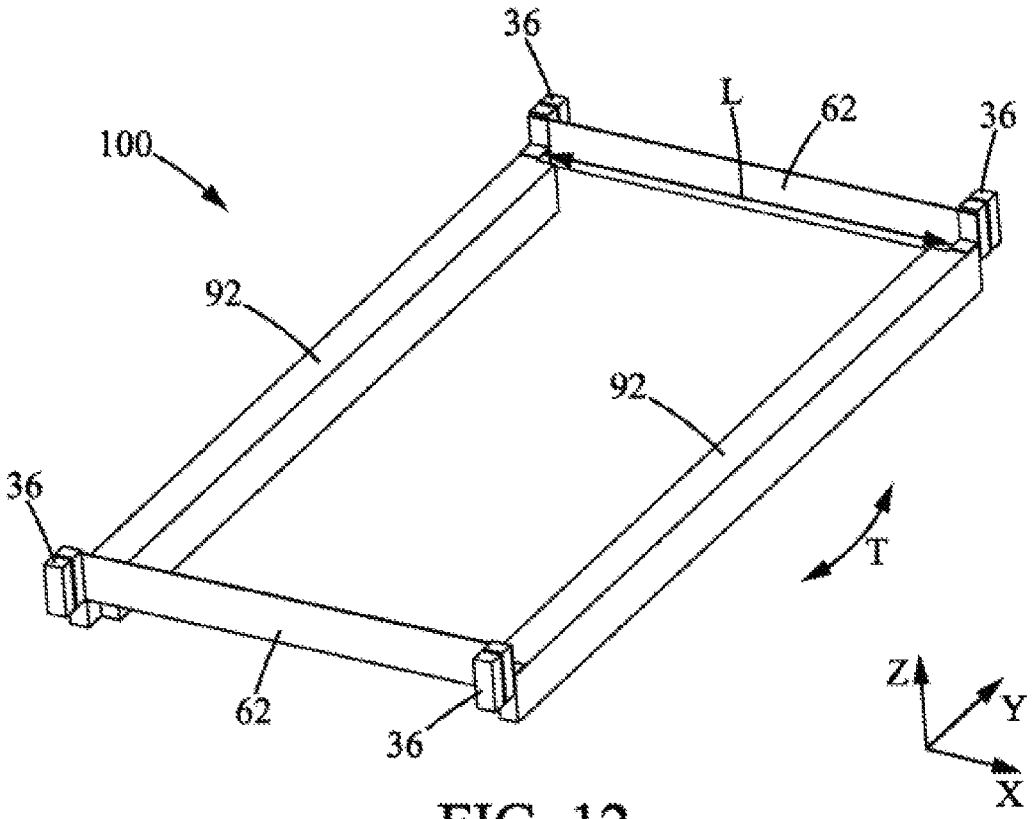

Finally, FIG. 12 illustrates the flexible mechanism 100 ultimately obtained. This flexible mechanism essentially comprises the two masses 92, the two flexible blades 62 connecting the masses 92, and the pallets 36 connecting the ends of the blades 62 to the masses 92.

In the illustrated example, the blades 62 are more flexible than the masses 92 and pallets 36. In particular the blades 62 are made of a more flexible material than the masses 92 and possibly the pallets 36. The flexible mechanism 100 can thus form an oscillator.

It should be noted here that the blades 62 are oriented so that they allow the flexible mechanism 100 to oscillate in a plane extending substantially in directions X and Y. In contrast, in the flat multilayer structure 68, the blades 62 were oriented so that they tended to oscillate in a plane normal to this plane.

The blades 62 are for example made of one among: silicon, glass, sapphire or alumina, diamond, in particular synthetic diamond, more particularly synthetic diamond obtained by a chemical vapor deposition process, titanium, a titanium alloy, particularly an alloy of the Gum Metal® family and an alloy of the elinvar family, more particularly Elinvar®, Nivarox®, Thermelast®, NI-Span-C®, and Precision C®.

These materials have the advantage that their Young's modulus is very insensitive to temperature variations. This is particularly advantageous in the field of making timepieces, for example, where the mechanism, in particular the regulating member, must maintain its precision, even during temperature variations.

Gum Metals® are materials comprising: 23% niobium; 0.7% tantalum; 2% zirconium; 1% oxygen; optionally vanadium; and optionally hafnium.

Elinvar alloys are nickel-iron alloys comprising nickel and chromium which are very insensitive to temperature. Elinvar®, in particular, is a nickel-iron alloy comprising 59% iron, 36% nickel, and 5% chromium.

NI-Span-C® comprises between 41.0 and 43.5% nickel and cobalt; between 4.9 and 5.75% chromium; between 2.20 and 2.75% titanium; between 0.30 and 0.80% aluminum; not more than 0.06% carbon; not more than 0.80% manganese; not more than 1% silicon; not more than 0.04% sulfur; not more than 0.04% phosphorus; and the supplemental iron needed to reach 100%.

Precision C® comprises: 42% nickel; 5.3% chromium; 2.4% titanium; 0.55% aluminum; 0.50% silicon; 0.40% manganese; 0.02% carbon; and the supplemental iron needed to reach 100%.

Nivarox® comprises: between 30 and 40% nickel; between 0.7 and 1.0% beryllium; between 6 and 9% molybdenum and/or 8% chromium; optionally, 1% titanium; between 0.7 and 0.8% manganese; between 0.1 and 0.2% silicon; carbon, up to 0.2%; and the supplemental iron.

Thermelast® comprises: 42.5% nickel; less than 1% silicon; 5.3% chromium; less than 1% aluminum; less than 1% manganese; 2.5% titanium; and 48% iron.

All the above compositions are indicated in percents by weight.

The blade or blades advantageously have a thickness greater than or equal to 1 μm, preferably greater than or equal to 5 μm, and/or less than or equal to 30 μm, preferably less than or equal to 20 μm, more preferably less than or equal to 15 μm.

The blade or blades may further have a width greater than or equal to 0.1 mm and/or less than or equal to 2 mm, preferably less than or equal to 1 mm.

The blade or blades may also have a length, for example, between 5 and 13 mm.

The or each blade 62 may also have an aspect ratio, defined as the ratio between the width and the thickness of the blade, greater than 10, preferably greater than 25.

The masses 92 are, for example, of one among: tungsten, molybdenum, gold, silver, tantalum, platinum, alloys comprising these elements and a polymer material loaded with particles of a density greater than ten, in particular tungsten particles. These materials are indeed heavy. In the case of a mechanism 100 forming an oscillator, this makes it possible to have masses 92 of reduced dimensions but with a relatively large weight.

The pallets 36, and therefore the first, third, and fifth layers 10, 58, 64, are for example of polymeric materials. These pallets 36 can improve the impact resistance of the mechanism 100.

As indicated above, the mechanism 100 may advantageously form an oscillator. In this case, one of the masses 92 may form a frame or be fixed rigidly to a frame, the other mass 92 oscillating relative thereto. In the current case, one of the masses 92 oscillates in a circular translational movement T relative to the other mass 92. In such a case, a high aspect ratio of the blade or of each blade 62 allows limiting the oscillation modes of this or these blades 62 out of plane.

Advantageously, the or each blade 62 has a free length L greater than or equal to one third of the width of the blade 62. In the case where the blade is fixed to a single mass, the free length is defined as being the length of the blade that is not in contact with the mass. In the case where the blade is fixed to two masses, the free length refers to the length of the blade, between the two masses, which is not in contact with one or the other of the masses. Preferably, over the free length of the blade 62, the latter is not in contact with any other element of the mechanism integrating the blade or blades 62.

A flexible mechanism of the type in FIG. 12, meaning of the type comprising at least one flexible blade between at least one mass, preferably between two, obtained by implementing the method described above, can in particular be implemented in a timepiece movement in a timepiece, particularly as a regulating member of such a timepiece movement.

Figure 13:
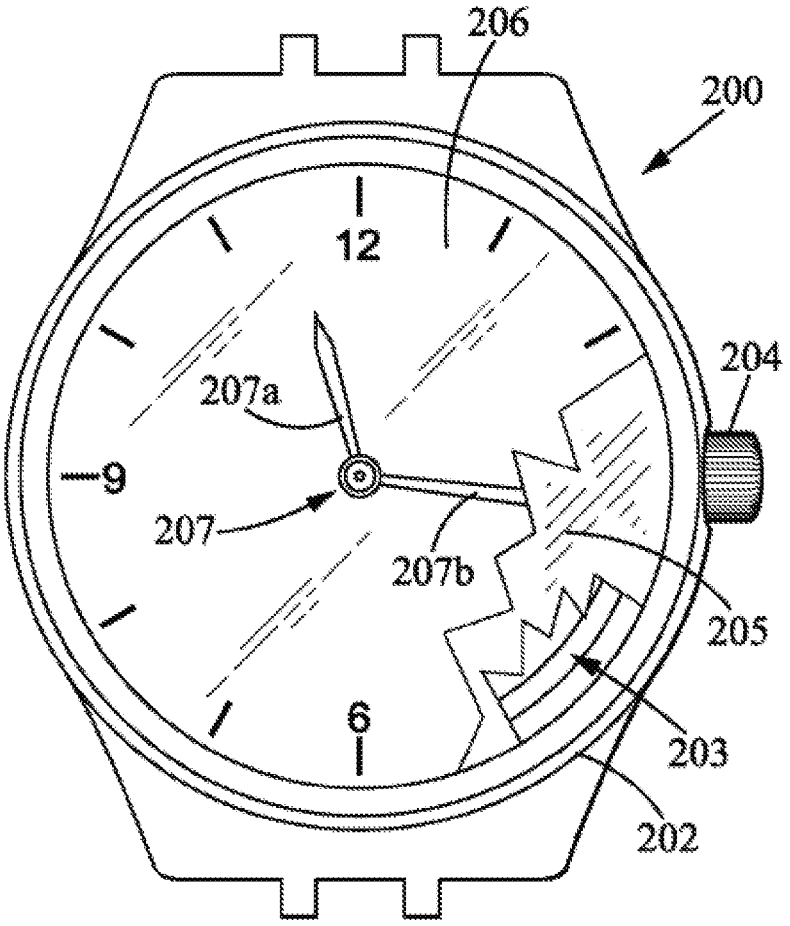
FIG. 13 is a schematic view of a timepiece comprising a timepiece movement.

In a known manner, a timepiece 200 such as the watch illustrated in FIG. 13 essentially comprises:

- a case 202,
- a timepiece movement 203 contained in the case 202,
- generally, a winding mechanism 204,
- a dial 205,
- a crystal 206 covering the dial 205,
- a time indicator 207, for example comprising two hands 207*a*, 207*b* for the hours and minutes respectively, placed between the crystal 206 and the dial 205 and actuated by the timepiece movement 203.

Figure 14:
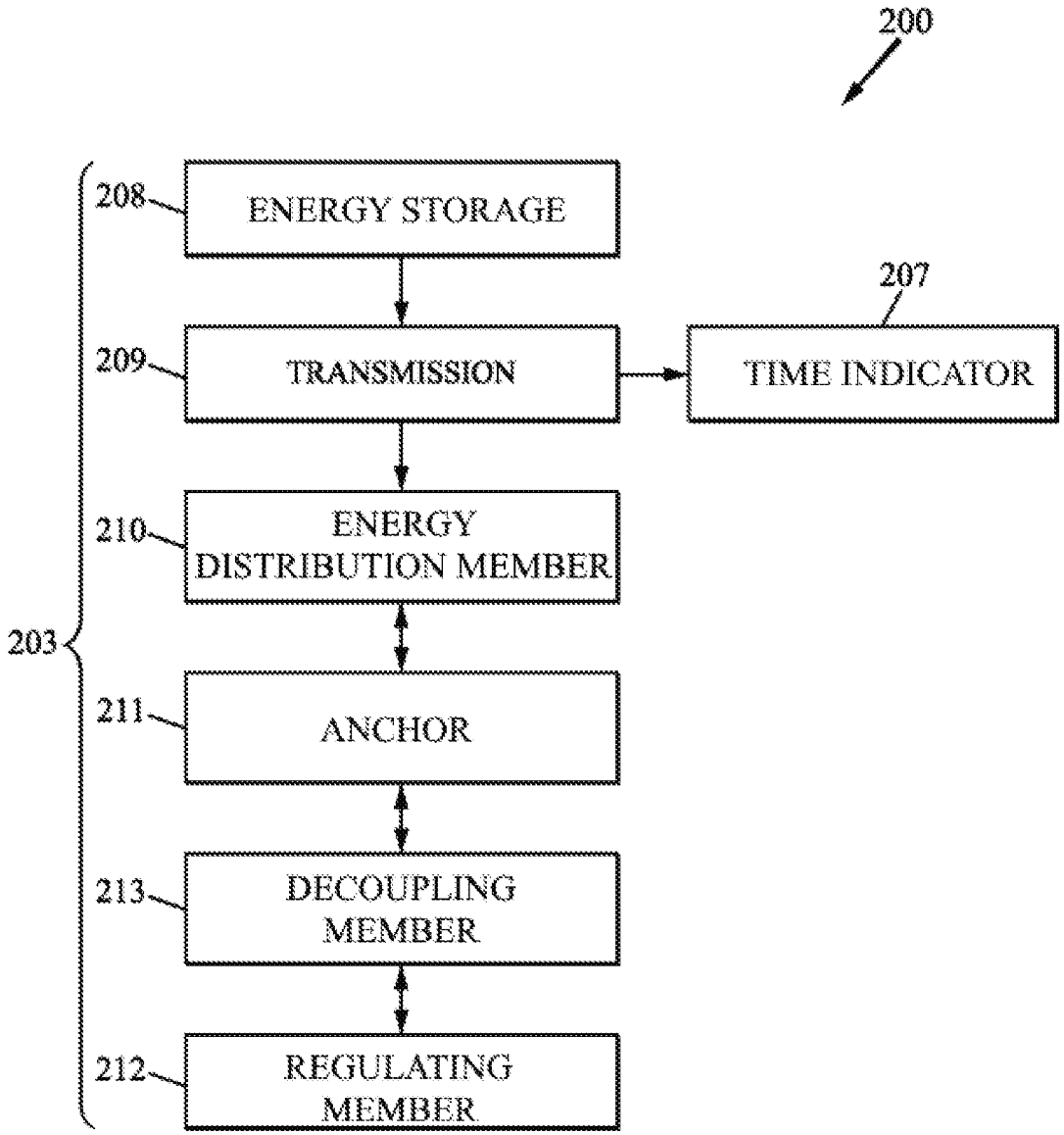
FIG. 14 is a block diagram of the timepiece movement of the timepiece of FIG. 13.

As is schematically shown in FIG. 14, the timepiece movement 203 may comprise for example:

- a device 208 for storing mechanical energy, generally a mainspring,
- a mechanical transmission 209 driven by the device 208 for storing mechanical energy,
- the time indicator 207 mentioned above,
- an energy distribution member 210 (for example an escape wheel),
- an anchor 211 adapted to sequentially retain and release the energy distribution member 210,
- a regulating member 212, which is a mechanism comprising an oscillating regulating element controlling the anchor 211 to move it regularly, so that the energy distribution member is moved increment by increment at constant time intervals, and, possibly,
- a decoupling member 213, which is interposed between the regulating member 212 and the anchor 211.

The invention is not limited to the single embodiment described above with reference to the figures, but on the contrary is capable of many variants accessible to those skilled in the art.

Firstly, in the example method described, the masses are fixed to the blades, more specifically at the ends of the blades, after deployment of the multilayer structure. In the example described, this is done using brazing. Alternatively, however, the masses are fixed to the blade or blades, in particular at the ends of these blades, by overmolding, clamping, clipping, gluing, welding, particularly spot welding, more particularly laser spot welding, or any other method accessible to those skilled in the art.

The masses may be attached on the deployed multilayer structure in the form of a cutout into a layer of additional material that is superimposed on the deployed multilayer structure. The cutout into the layer of additional material may in particular form housings for receiving the ends of the flexible blades, in particular pallets fixed to the ends of the blades, the receiving then preferably being carried out with clamping.

Also, according to a variant, the masses may be formed by the multilayer structure. The masses are then arranged facing the ends of the blades or the pallets attached to these ends at the time of deployment of the multilayer structure.

Furthermore, the described example method comprises a step of locking the structure in the deployed position. This step is optional in principle. It is preferred, however, when further manipulations of the deployed structure are required in order to obtain the mechanism. In the case where such locking is to be performed, it can be obtained by any means accessible to those skilled in the art, in particular by gluing, overmolding, brazing, clipping, welding, particularly spot welding, more particularly laser spot welding, or more generally by fastening together elements of the structure in the deployed position.

In addition, the method for manufacturing a mechanism may include a step of assembling many layers atop one another. Preferably, however, the number of superimposed layers of material is between ten and fifty.

Finally, in the example described, a single mechanism 100 is obtained by implementing the method. However, advantageously, it may be provided that a same stack of layers enables the formation of a plurality of multilayer structures and/or a plurality of deployed structures. It is thus possible to substantially improve the yield of the method for manufacturing a mechanism.

Finally, the serrated edges mentioned in the described example may be replaced by fold starters. In particular, the fold starters may be made by partial cuts into the layers. The partial cuts may consist of dotted cuts and/or a cut into only some of the thickness of the layers. In the case of a cut into only some of the thickness of the layers, the partial cut may possibly be continuous. A complete cut through the layers may also be considered.

The invention claimed is:

1. A method for manufacturing at least a part of a timepiece comprising the steps of:

i) assembling a plurality of flat layers together to form a flat multilayer structure;

ii) deploying the multilayer structure including the plurality of flat layers in a direction normal to the assembled flat layers, wherein at least a first layer of said layers forms at least one flexible blade in the part of the timepiece; and iii) fixing each of the at least one flexible blade to the at least one mass in a step subsequent to step (ii), wherein each of the at least one mass being more rigid than the at least one flexible blade to which it is fixed.

2. The method according to claim 1, wherein each of the at least one flexible blade has, in the part of the timepiece, a free length greater than one third of the width of the blade, the free length being defined as being one among:

a length of the blade on which the blade is not in contact with the mass, in the case where the blade is fixed to only one mass, and the length of the blade extending between two masses on which the blade is not in contact with an of the masses, in the case where the blade is fixed to two masses.

3. The method according to claim 1, wherein the at least one mass is attached to an end of one of said at least one blade.

4. The method according to claim 1, wherein the at least one mass is fixed to the at least on flexible blade by:

overmolding;

brazing;

clipping;

gluing;

welding; or clamping.

5. The method according to claim 1, wherein the at least one mass is created by at least one of the flat layers assembled in step i).

6. The method according to claim 1, wherein the at least one mass is of one among: tungsten, molybdenum, gold, silver, tantalum, platinum, alloys comprising at least one among tungsten, molybdenum, gold, silver, tantalum and platinum, and a polymer material loaded with particles of a density greater than ten.

7. The method according to claim 1, wherein the at least one flexible blade of one among: silicon, glass, sapphire, diamond, titanium, a titanium alloy and an alloy of steel, nickel and chromium.

8. The method according to claim 1, wherein, in step (i), ten to fifty flat layers are assembled together.

9. The method according to claim 1, wherein the at least one flexible blade has a width, a thickness, and an aspect ratio defined as being equal to the ratio of the width of the at least one flexible blade to the thickness of the at least one flexible blade, the aspect ratio of the at least one flexible blade being greater than 10.

10. The method according to claim 1, wherein the at least one flexible blade has a thickness greater than or equal to 1 μm and less than or equal to 30 μm.

11. The method according to claim 1, wherein the at least one flexible blade has a width greater than or equal to 0.1 mm and less than or equal to 2 mm.

12. The method according to claim 1, wherein each layer undergoes a machining step.

13. The method according to claim 1, wherein a plurality of flat multilayer structures to be deployed in step (ii) are obtained from a single assembling of layers in step (i).

14. The method according to claim 1, wherein the at least one blade is of a more flexible material than the at least one mass which is fixed to said at least one blade.

15. The method according to claim 1, wherein a plurality of structures in the deployed position are obtained in the deploying from a single assembling of layers in step (i).

16. A method for manufacturing at least a part of a timepiece comprising the steps of:

i) assembling flat layers together to form a flat multilayer structure; and ii) deploying the multilayer structure in a direction normal to the assembled flat layers;

wherein at least a first layer of said layers forms at least one flexible blade in the part of the timepiece, each of the at least one flexible blade being fixed, in the part of the timepiece, to at least one mass, each of the at least one mass being more rigid than the at least one flexible blade to which it is fixed, each of the at least one flexible blade being fixed to the at least one mass in a step subsequent to step (ii), the method further comprising a step (iii) subsequent to step (ii), consisting of locking the multilayer structure in the deployed position.

17. The method according to claim 16, wherein, in step (iii), the structure is locked in the deployed position by at least one among: an overmolding, brazing, clipping, gluing, welding, and clamping.

18. A method for manufacturing at least a part of a timepiece comprising the steps of:

i) assembling flat layers together to form a flat multilayer structure; and ii) deploying the multilayer structure in a direction normal to the assembled flat layers;

wherein at least a first layer of said layers forms at least one flexible blade in the part of the timepiece, each of the at least one flexible blade being fixed, in the part of the timepiece, to at least one mass, each of the at least one mass being more rigid than the at least one flexible blade to which it is fixed, each of the at least one flexible blade being fixed to the at least one mass in a step subsequent to step (ii), wherein the flat multilayer structure forms at least one mounting scaffold, the method further comprising a step L, consisting of detaching the structure in the deployed position, from the at least one mounting scaffold.

* * * * *